US007938059B2

(12) United States Patent
Moreno et al.

(10) Patent No.: US 7,938,059 B2
(45) Date of Patent: May 10, 2011

(54) PRESSURE ATTENUATED PUMP PISTON

(75) Inventors: Alejandro Moreno, El Paso, TX (US); Santos Burrola, Chih (MX)

(73) Assignee: Delphi Technologies, Inc., Troy, MI (US)

( * ) Notice: Subject to any disclaimer, the term of this patent is extended or adjusted under 35 U.S.C. 154(b) by 440 days.

(21) Appl. No.: 12/151,264

(22) Filed: May 5, 2008

(65) Prior Publication Data

US 2009/0272260 A1 Nov. 5, 2009

(51) Int. Cl.
*F01B 31/00* (2006.01)
*F16J 1/10* (2006.01)

(52) U.S. Cl. ..... 92/181 R; 92/129; 92/183

(58) Field of Classification Search ..... 92/129, 92/181 R, 181 P, 183, 248, 249; 417/541
See application file for complete search history.

(56) References Cited

U.S. PATENT DOCUMENTS

| | | | | |
|---|---|---|---|---|
| 2,968,287 | A * | 1/1961 | Creighton | 92/183 |
| 3,896,707 | A * | 7/1975 | Holmstrom | 92/248 |
| 5,236,253 | A * | 8/1993 | Glasmacher | 303/87 |
| 5,551,767 | A * | 9/1996 | Linkner, Jr. | 303/87 |
| 6,093,003 | A * | 7/2000 | Hauser et al. | 417/541 |
| 6,595,105 | B2 * | 7/2003 | An et al. | 92/140 |

* cited by examiner

*Primary Examiner* — Michael Leslie
(74) *Attorney, Agent, or Firm* — Thomas N. Twomey

(57) ABSTRACT

A pump piston assembly for use with a high-pressure pump includes a first section extending axially from a first end, a second section positioned adjacent to the first section and extending axially towards a second end, and an attenuation feature disposed within the piston bore such that the attenuation feature is part of the second end. By integrating the attenuation feature directly into the pump piston, pressure spikes, such as pressure peaks and valleys of an oscillatory pressure wave originating from the reciprocating motion of the piston, may be compensated directly in a supply pressure chamber. By providing a variety of attenuation features, such as a ball/spring assembly, an elastomer insert, an elastomer insert/internal piston assembly, and an elastomer insert/spring/ball assembly, attenuation for applications with a variety of frequencies and pressures can be utilized.

12 Claims, 4 Drawing Sheets

PRESSURE ATTENUATED PUMP PISTON

TECHNICAL FIELD

The present invention relates to piston pumps; more particularly, to pump piston assemblies for application in internal combustion engines; and most particularly, to a pressure attenuated pump piston and to a method for attenuating pressure oscillation of a piston pump.

BACKGROUND OF THE INVENTION

Piston pumps as pressure source for high-pressure applications are well known. Piston pumps may be, for example, single acting reciprocating pumps where a piston draws fluid into a cylinder when stroked in one direction, and pressurizes then expels fluid from the cylinder when stroked in the other direction. Thus, the pump delivers a single pressurized charge of fluid during each stroking cycle. Piston pumps are frequently used in the automobile industry, for example in internal combustion engines, to pump fluids, such as gasoline, engine oil, and transmission fluid at various pressures and speeds.

While piston pumps may be able to generate pressures of 2000 psi and higher, piston pumps typically produce an oscillatory pressure wave originating from the reciprocating piston motion that is characteristic of the piston drive mechanization. Pressure oscillations may create performance noise as well as performance interactions with pressure control devices, such as accumulators or solenoids, downstream of the piston pump. In traditional hydraulic circuit designs, when needed and/or if packaging size allows, accumulators are placed separately in the fluid delivery system to attenuate the pressure peak and valleys of the oscillatory pressure. Typical accumulators are predetermined volumes containing diaphragms, bladders, or bellows, which use the compressibility of gases or elastomers to add compliance, thereby reducing the pressure oscillations produced by the pump piston. The challenge with this traditional approach is the need to find additional packaging space to add accumulators to the hydraulic circuit.

What is needed in the art is a mechanism for attenuating pressure oscillations of a piston pump that does not take up additional packaging space in an assembly.

It is a principal object of the present invention to provide a pressure attenuator that is integrated directly into the piston of a piston pump.

It is a further object of the invention to provide a device and method for compensating pressure spikes directly in the supply pressure chamber.

SUMMARY OF THE INVENTION

Briefly described, a high-pressure piston pump that is capable of supplying a pressure with reduced or no pressure spikes and that has a smaller package size than comparable prior art pumps is provided. Pressure attenuating features are incorporated directly into a piston of a piston pump to eliminate the need to package an independent accumulator as in the prior art. The attenuation features in accordance with the invention may include a ball/spring assembly, an elastomer insert, an elastomer insert/internal piston assembly, an elastomer insert/ball assembly, and an elastomer/spring/ball assembly. The spring, the elastomer, the internal piston, and the ball are used in one embodiment of the invention as energy absorbers to achieve the desired pressure control. Accordingly, a variety of attenuators are provided that may be chosen in accordance with requirements for a specific application, for example, high-pressure fast response or lower pressure and lower response.

A section of the piston of the piston pump is designed to receive the attenuation feature, such that the features do not extend substantially beyond the face of the piston. By integrating the attenuation features directly into the pump piston, spikes of pressure oscillations originating from the reciprocating motion of the piston during typical operation of a piston pump can be compensated directly in the supply pressure chamber. Furthermore, the pressure attenuation volume is captured inside the piston face and/or piston stem.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates preferred embodiments of the invention, in one form, and such exemplification is not to be construed as limiting the scope of the invention in any manner.

DESCRIPTION OF THE PREFERRED EMBODIMENTS

Figure 1:
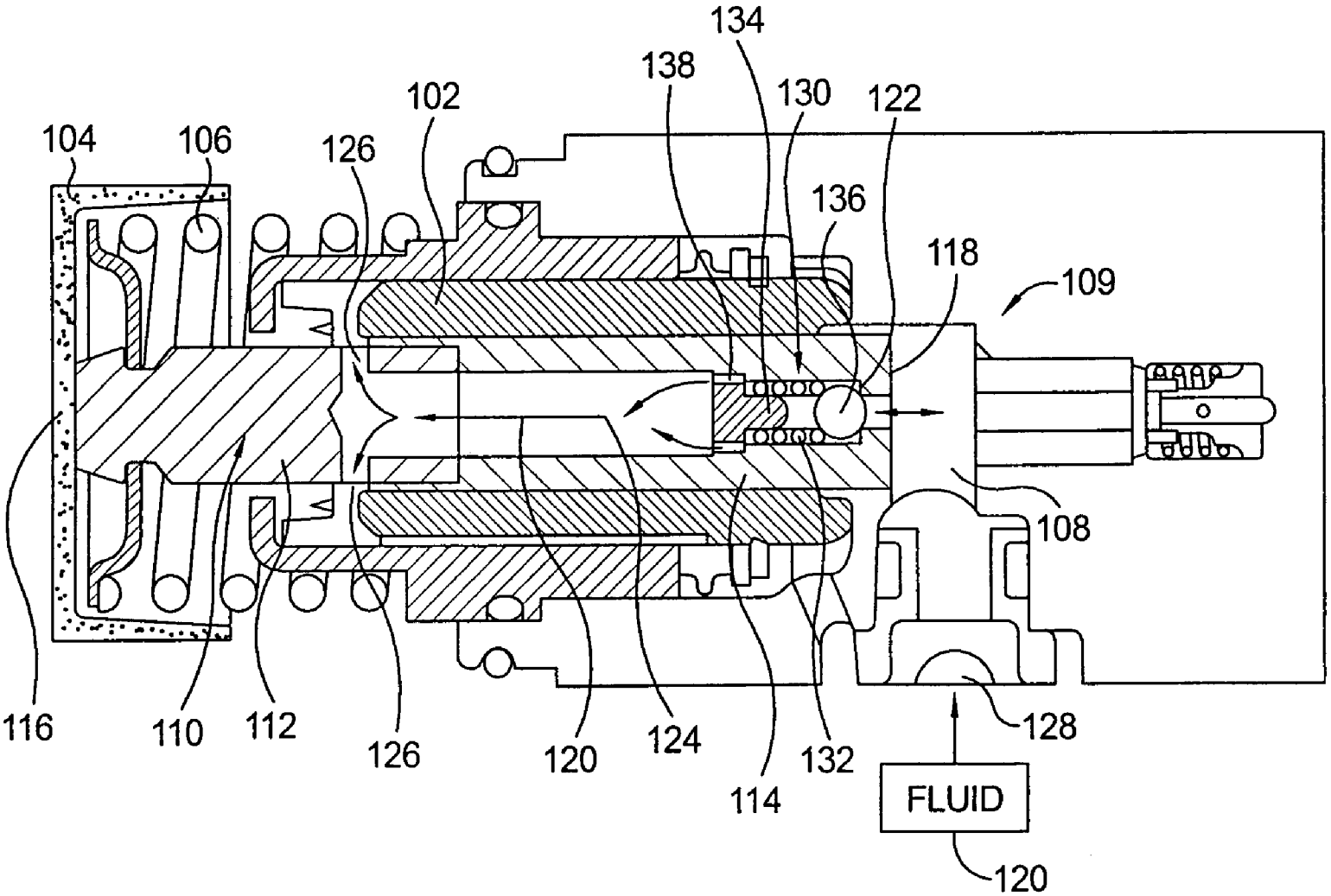
FIG. 1 is a cross-sectional view of a piston pump in accordance with a first embodiment of the invention.
Figure 2:
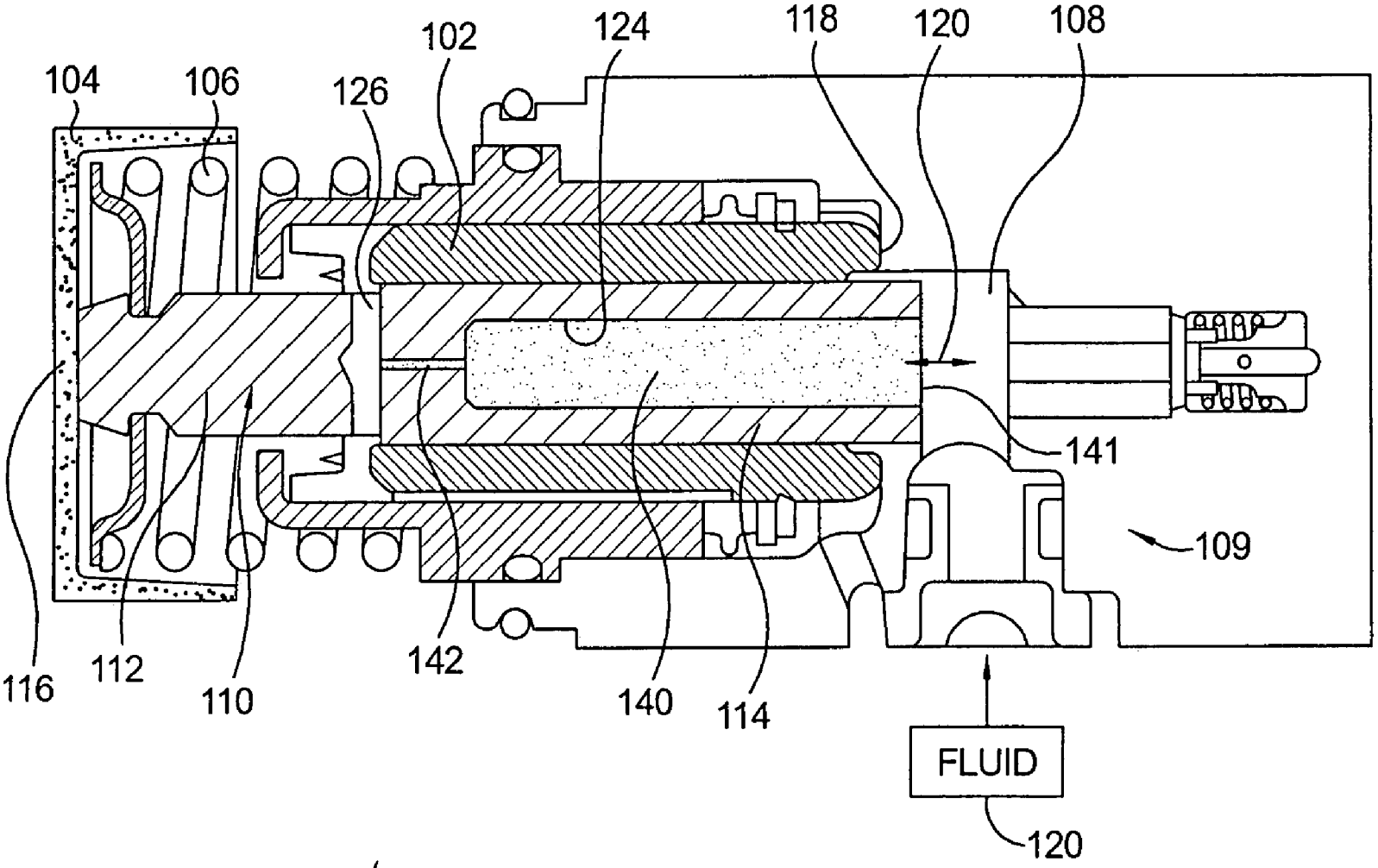
FIG. 2 is a cross-sectional view of a piston pump in accordance with a second embodiment of the invention.
Figure 3:
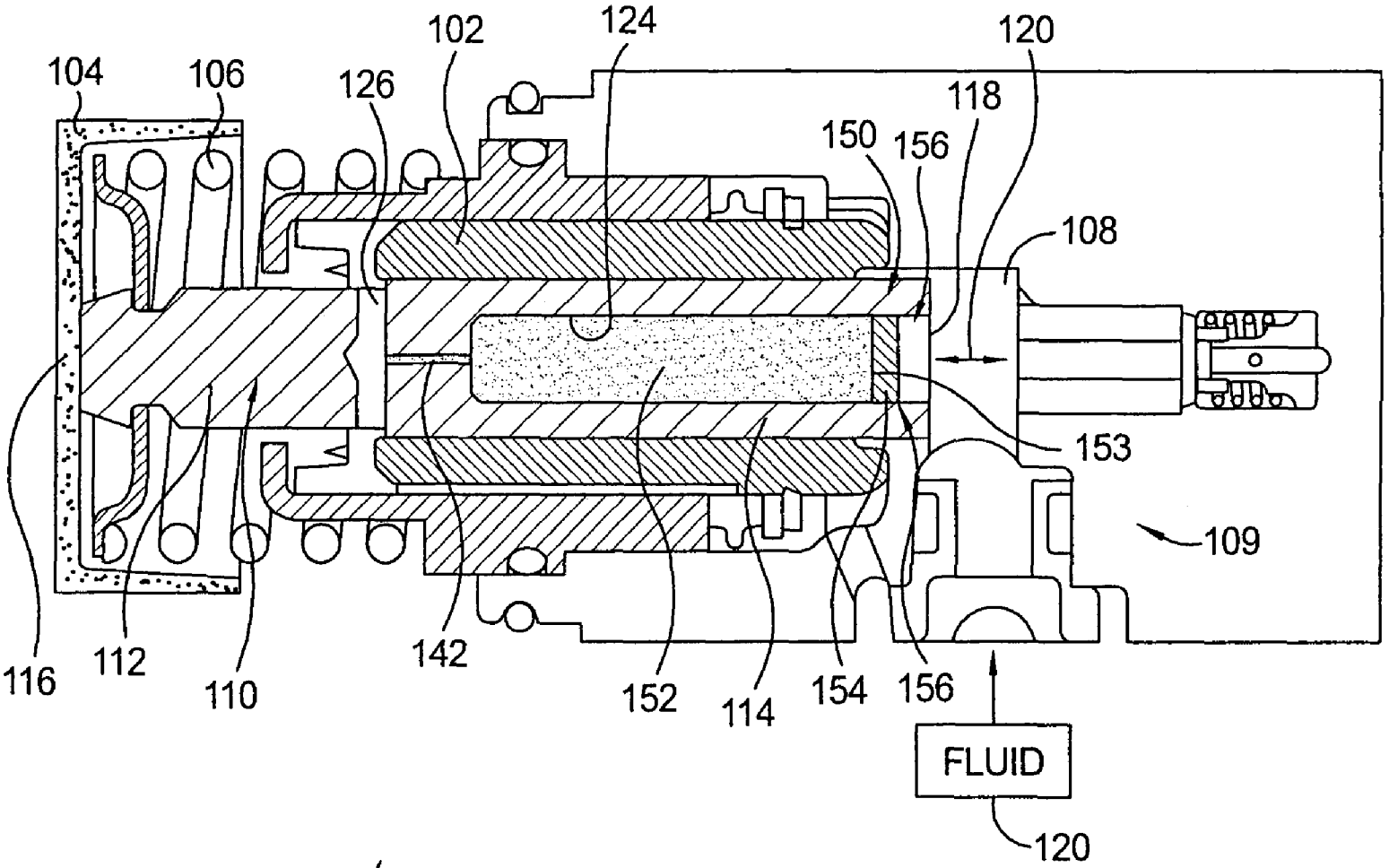
FIG. 3 is a cross-sectional view of a piston pump in accordance with a third embodiment of the invention.
Figure 4:
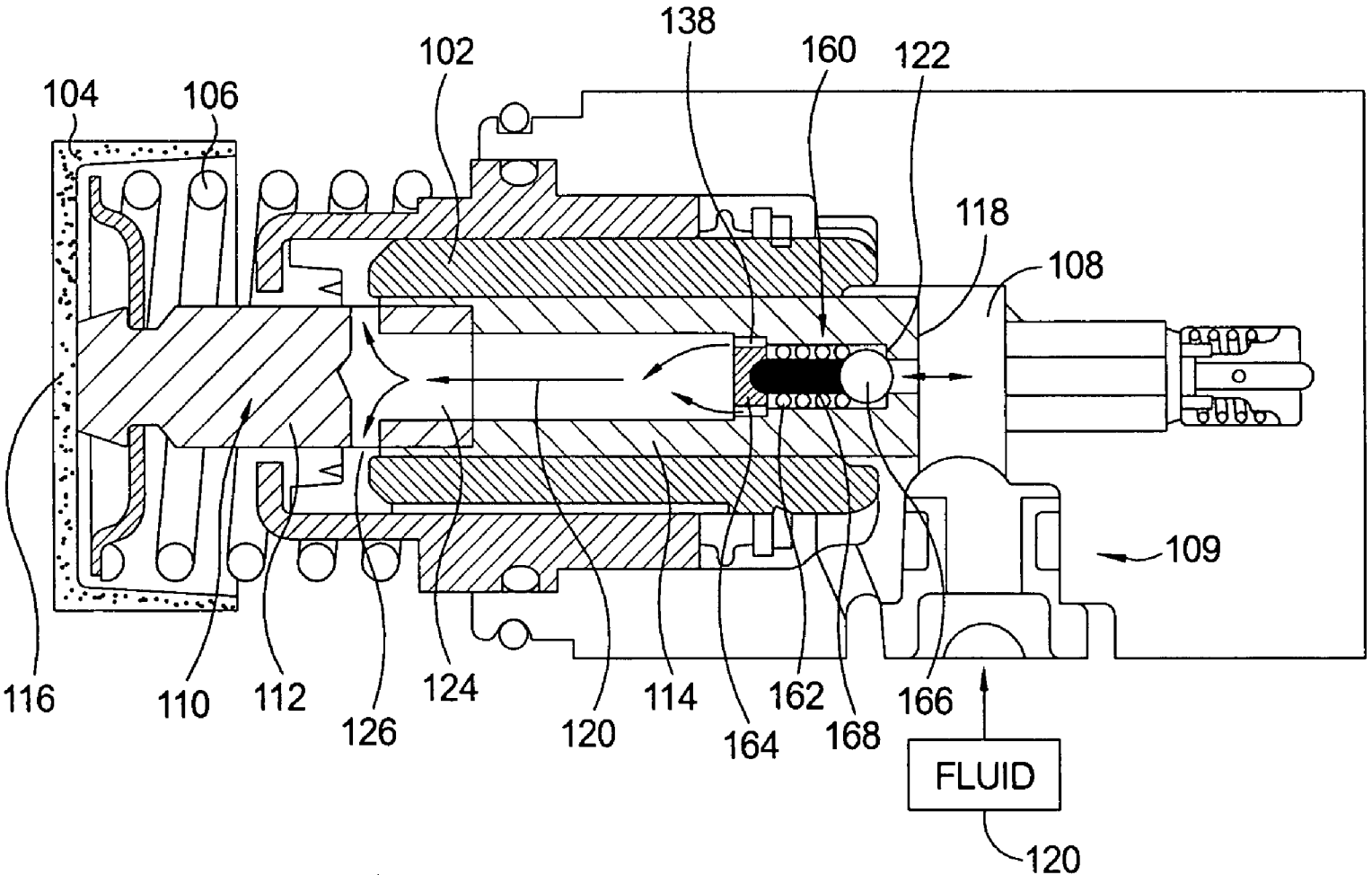
FIG. 4 is a cross-sectional view of a piston pump in accordance with a fourth embodiment of the invention.

Referring to FIGS. 1 through 4, piston pumps 100, 200, 300, and 400 in accordance with a first, second, third, and fourth embodiment of the invention, respectively, include a pump piston 110 positioned axially movable within a pump sleeve 102. Pump piston 110 includes a first section 112 and a second section 114, such that pump piston 110 axially extends from a first end 116 and to a second end 118. Second end 118 constitutes the face of pump piston 110. First section 112 may have a smaller outer diameter than second section 114. First section 112 may be formed separately from second section 114 and may be, for example, press fitted into second section 114, as shown in FIGS. 1 and 4. In an alternative embodiment, pump piston 110 may be formed as an integral piece as shown in FIGS. 2 and 3. Pump piston 110 further includes a piston bore 124 that axially extends from second end 118 through second section 114 into first section 112 in the center of piston 110. The axial extension of piston bore 124 terminates at cross holes 126 that are included in first section 112.

First section 112 acts against a cap 104 that houses a spring 106. A cam lobe (not shown) acting against cap 104 from the opposite side than first section 112 of piston 110 compresses and relaxes spring 106 thereby causing reciprocating movement of piston 110 in an axial direction. If spring 106 is relaxed, a fluid 120 enters a supply pressure chamber 108 of a fluid supply assembly 109 through an inlet 128. The passage of fluid 120 is indicated by arrows 120. If spring 106 is being compressed, piston 110 moves towards supply pressure chamber 108 thereby compressing fluid 120 with second end 118 in supply pressure chamber 108. Accordingly, the motion and pressure is applied to fluid 120 by the reciprocating movement of the pump piston 110 in pump sleeve 102.

Piston pumps 100, 200, 300, and 400 as shown in FIGS. 1, 2, 3, and 4, respectively, may be each a high-pressure pump used to compress a fluid, such as a gas or a liquid, for example, gasoline, transmission fluid or engine oil, for example, at pressures as high as about 2000 psi or above. An oscillatory pressure wave that typically originates from the reciprocation motion of piston 110 can be attenuated by integrating attenuation features 130, 140, 150, and 160 as shown in FIGS. 1-4 and as described below.

Referring now to FIG. 1, a ball/spring assembly 130 is disposed as attenuation feature within piston bore 124 of piston pump 100 in accordance with a first embodiment of the invention. Ball/spring assembly 130 is positioned proximate to second end 118 of piston 110 and includes a spring 132 that has a plug 134 attached at an end facing the interior of piston 110 and a ball 136 attached at an opposite end facing second end 118 of piston 110. A valve seat 122 is integrated into second section 114 at second end 118. Plug 134 is assembled within piston bore 124, for example by press fitting, to provide a desired compressive load on spring 132. Plug 134 includes a plurality of vents 138 at an outer circumferential contour that allow flow of fluid 120 through plug 134. Spring 132 keeps ball 136 seated in valve seat 122 and applies a mechanical preload to ball 136.

When fluid 120 is compressed, the pressure at second end 118, at the face of piston 110, increases. If the pressure at the second end 118 increases above the mechanical preload of ball 136, ball 136 is pushed off of seat 122 against spring 132 and fluid 120 is able to flow within piston bore 124 through vents 138 of plug 134 towards first end 116. Fluid 120 exits piston bore 124 through cross-holes 126. Once fluid 120 has entered piston bore 124, fluid 120 exhibits a low pressure due to the connection of piston bore 124 to the low pressure side of piston pump 100 via cross-holes 126.

By setting the position of plug 134 within bore 124 of piston 110, the preload of the ball 136 may be adjusted in accordance with the desired pressure at the face (second end) 118 of piston 110. Accordingly, the preload on ball 136 may be set to achieve the desired pressure value of the pumped fluid. By allowing fluid 120 to flow past the ball and seat at a preset pressure, ball/spring assembly 130 reduces or eliminates pressures spikes, such as pressure peaks and pressure valleys, of an oscillatory pressure wave originating from the reciprocating piston motion that is characteristic of the drive mechanization of piston 110 as described above. Since ball/spring assembly 130 depends on the mechanical response of ball 136 and spring 132, it may be primarily useful for lower frequency and/or lower pressure applications. In an alternative embodiment it may be possible to replace ball 136 with an internal piston similar to internal piston 154 shown in FIG. 3, as described in more detail further below.

Referring to FIG. 2, an elastomer insert 140 is disposed as an attenuation feature within piston bore 124 of a piston pump 200 in accordance with a second embodiment of the invention. Elastomer insert 140 may be inserted into piston bore 124, for example by a molding process, to fill piston bore 124 completely such that elastomer insert 140 extends toward and becomes part of the face (second end 118) of piston 110. The end face 141 of elastomer insert 140 is substantially flush with second end 118 of piston 110 and becomes part of the face of pump piston 110. In this embodiment, piston bore 124 for receiving insert 140 may extend from second end 118 of piston 110 through at least part of second section 114. A vent hole 142 connects piston bore 124 with cross-holes 126. Vent hole 142 is needed for the molding process to ensure that the entire interior of piston bore 124 is filled with the elastomer material, without air pockets or voids. The elastomer material for elastomer insert 140 may be selected according to the type of fluid 120 that is compressed, and thereby in contact with elastomer insert 140, and according to the pressure that is created. For example, rubber may be used as elastomer material for elastomer insert 140. When the pressure reaches a value that is higher than the indentation resistance of the elastomer material, such as its durometer hardness, the elastomer insert 140 is compressed. Elastomer insert 140 is almost instantaneously compressible and has, therefore, a faster response than ball/spring assembly 130 shown in FIG. 1.

Referring to FIG. 3, an elastomer insert/internal piston assembly 150 is disposed as attenuation feature within piston bore 124 of piston pump 300 in accordance with a third embodiment of the invention. Elastomer insert/internal piston assembly 150 is designed similar to elastomer insert 140 and includes an elastomer insert 152. However, an end face 153 of the insert is recessed in the piston bore and internal piston 154 is coupled to the end face of the insert. Internal piston 154 is disposed proximate to second end 118 of piston 110 such that internal piston 154 operably becomes aligned with the second end 118 of piston 110. In one aspect of the invention, internal piston 154 is rigid and may be a metal plate. Internal piston 154 may be held in place within piston bore 124 with retention features 156, such as a snap ring. Accordingly, internal piston 154 provides elastomer insert 152 with a rigid face. Therefore, elastomer insert/internal piston assembly 150 is able to withstand higher pressures than elastomer insert 140 (FIG. 2) while providing a similar fast response. In an alternative embodiment, it may be possible to replace the internal piston 154 with a ball and provide a ball seat 122 as shown in FIG. 1.

Referring now to FIG. 4, an elastomer insert/spring/ball assembly 160 is disposed as attenuation feature within piston bore 124 of piston pump 400 in accordance with a fourth embodiment of the invention. Elastomer insert/spring/ball assembly 160 includes a spring 162 that has a plug 164 attached at an end facing the interior of piston 110 and a ball 166 attached at an opposite end facing second end 118 of piston 110 similar to the ball/spring assembly 130 shown in FIG. 1. In addition, elastomer insert/spring/ball assembly 160 includes an elastomer insert 168. Elastomer insert 168 may be positioned within spring 162 and may extend from plug 164 to ball 166. Elastomer insert 168 is utilized for damping the movement of ball 166. Plug 162 is assembled within piston bore 124, for example by press fit, to provide a compressive load on both spring 162 and elastomer insert 168. The preload on ball 166, as provided by plug 164, may be thereby increased.

Since elastomer insert/spring/ball assembly 160 still depends on mechanical response of ball 166 and spring 162, it may be primarily useful for lower frequency applications. But, since elastomer insert 168 damps the movement of ball 166, elastomer insert/spring/ball assembly 160 may be used for applications that require higher pressures than can be accommodated by ball/spring assembly 130 and lower pressures than can be accommodated provided by elastomer insert/internal piston assembly 150.

By integrating attenuation features 130, 140, 150, and 160 directly into pump piston 110, pressure spikes, such as pressure peaks and valleys of an oscillatory pressure wave originating from the reciprocating motion of piston 110, may be compensated directly in the supply pressure chamber 108. Accordingly, a high-pressure piston pump, such as piston pump 100, 200, 300, or 400 shown in FIG. 1, FIG. 2, FIG. 3, and FIG. 4, respectively, is capable of supplying a pressure with reduced pressure spikes in a packaging size that is smaller than prior art pressure attenuation devices. By controlling the pressure spikes with the attenuation features 130, 140, 150, and 160 in accordance with the invention, a reduction of torque peaks, heat generation, and hydraulic noise, for example, may also be achieved.

By providing a variety of attenuation features, such as ball/spring assembly 130, elastomer insert 140, elastomer insert/internal piston assembly 150, and elastomer insert/spring/ball assembly 160, attenuation for applications with a variety of frequencies and pressures can be achieved.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A pump piston assembly for use with a high-pressure pump, comprising:

a first section extending axially from a first end;

a second section positioned adjacent to said first section and extending axially towards a second end;

a piston bore axially extending from said second end through said second section; and an attenuation feature disposed within said piston bore such that said attenuation feature is part of said second end;

wherein said attenuation feature comprises:

a ball/spring assembly positioned proximate to said second end, said ball/spring assembly including a spring grounded against a ball;

a plug assembled within said piston bore for providing compression to said spring; and an elastomer insert extending from said plug to said ball.

2. A high-pressure piston pump, comprising:

a pump sleeve;

a pump piston positioned axially moveable within said pump sleeve, said pump piston including a face that compresses a fluid during axial movement of said pump piston towards a supply pressure chamber; and an attenuation feature integrated into said pump piston proximate to said face, said attenuation feature reducing pressure peaks and valleys of an oscillatory pressure wave directly in said supply pressure chamber, wherein said oscillatory pressure wave originates from a reciprocating axial movement of said pump piston.

3. The piston pump in accordance with claim 2, wherein said pump piston includes a piston bore extending axially from said face, wherein said pump piston further includes at least one intersecting hole terminating within said piston bore, and wherein said piston bore receives said attenuation feature.

4. The piston pump in accordance with claim 1, wherein said attenuation feature is a ball/spring assembly including a spring grounded against a ball, wherein said face is formed as a valve seat receiving said ball.

5. The piston pump in accordance with claim 4, wherein a plug provides compression to said spring, and wherein said spring applies a mechanical preload to said ball.

6. The piston pump in accordance with claim 5, wherein said ball/spring assembly further includes an elastomer insert extending from said plug to said ball, and wherein said elastomer insert damps the movement of said ball.

7. The piston pump in accordance with claim 2, wherein said attenuation feature is an elastomer insert, and wherein said elastomer insert is disposed within a piston bore such that a face of the elastomer insert is proximate the face of said pump piston.

8. The piston pump in accordance with claim 7, wherein a material of said elastomer insert is chosen in accordance with the type of fluid in contact with said face of said pump piston and in accordance with a pressure that is created by said reciprocating movement of said pump piston.

9. The piston pump in accordance with claim 7, wherein said attenuation feature further includes an internal piston proximate said pump piston face.

10. A method for attenuating pressure oscillation of a piston pump, comprising the steps of:

integrating an attenuation feature into a pump piston such that said attenuation feature is coupled to a face of said pump piston;

reciprocating said pump piston to fill a supply pressure chamber with a fluid and to compress said fluid within said supply pressure chamber;

creating an oscillatory pressure wave with said reciprocating movement of said piston pump; and reducing pressure peaks and valleys of said oscillatory pressure wave with said attenuation feature directly in said supply pressure chamber.

11. The method of claim 10, further including the step of:

bleeding off fluid through said pump piston at a preset pressure.

12. The method of claim 10, further including the step of:

compressing said attenuation feature to compensate said pressure peaks and valleys.

* * * * *